US005279463A

United States Patent [19]

Holl

[11] Patent Number: 5,279,463

[45] Date of Patent: Jan. 18, 1994

[54] METHODS AND APPARATUS FOR TREATING MATERIALS IN LIQUIDS

[76] Inventor: Richard A. Holl, 4171-C5 Market St., Ventura, Calif. 93003

[21] Appl. No.: 935,277

[22] Filed: Aug. 26, 1992

[51] Int. Cl.[5] ..... B02C 19/18

[52] U.S. Cl. ..... 241/1; 241/17; 241/21; 241/29; 241/228; 241/237; 241/253; 241/261.1; 241/261.2; 241/301

[58] Field of Search ..... 241/1, 301, 17, 21, 241/29, 250, 253, 257.1, 261.1, 261.2, 228, 237

[56] References Cited

U.S. PATENT DOCUMENTS

| | | | |
|---|---|---|---|
| 591,494 | 10/1897 | Pond | 241/237 |
| 2,261,257 | 11/1941 | Kiesskalt et al. | 241/228 |
| 4,071,225 | 1/1978 | Holl | 366/127 X |
| 4,556,467 | 12/1985 | Kuhn et al. | 241/1 X |
| 4,784,218 | 11/1988 | Holl | 138/38 X |
| 4,930,708 | 6/1990 | Chen | 241/261.2 X |

FOREIGN PATENT DOCUMENTS

| | | | |
|---|---|---|---|
| 220906 | 4/1985 | German Democratic Rep. | 241/1 |
| 369939 | 4/1973 | U.S.S.R. | 241/1 |
| 957991 | 9/1982 | U.S.S.R. | 241/301 |
| 891152 | 3/1962 | United Kingdom | 241/1 |
| 1232644 | 5/1971 | United Kingdom | 241/1 |

*Primary Examiner*—Mark Rosenbaum
*Assistant Examiner*—Frances Chin

[57] ABSTRACT

The method for treating materials in liquids involves passing them with the liquid through a processing gap formed by a flow passage whose walls are closely spaced and move relative to one another transversely to the direction of flow, thereby producing "supra-kolmogoroff" mixing eddies in the gap, and at the same time applying ultrasonic longitudinal pressure oscillations that reverberate between the two closely spaced surfaces into the gap transversely to the direction of flow from transducers mounted on one wall, thereby producing "sub-Kolmogoroff" mixing eddies therein. The method is capable of rapidly producing relatively thick slurries of sub-micrometer particles that otherwise can take several days in conventional high shear mixers and ball or sand mills, or of rapidly dissolving difficultly soluble gases and powders into liquids. One type of apparatus consists of two circular coaxial plates, one stationary while the other is rotated, the opposed faces forming the processing gap being mirror finished; the rotational axis can be vertical or horizontal. Another type consists of an inner cylinder rotatable about a horizontal axis inside a stationary hollow outer cylinder with the facing walls closely spaced at their lowermost parts to form the processing gap. The ultrasonic transducers are mounted on the stationary member. The liquid/material mixture may be recirculated through a single mill or may be passed through a series of mills. The mixture may be pretreated in a high capacity reverbatory ultrasonic mixer before being fed to the mill or series of mills.

22 Claims, 8 Drawing Sheets

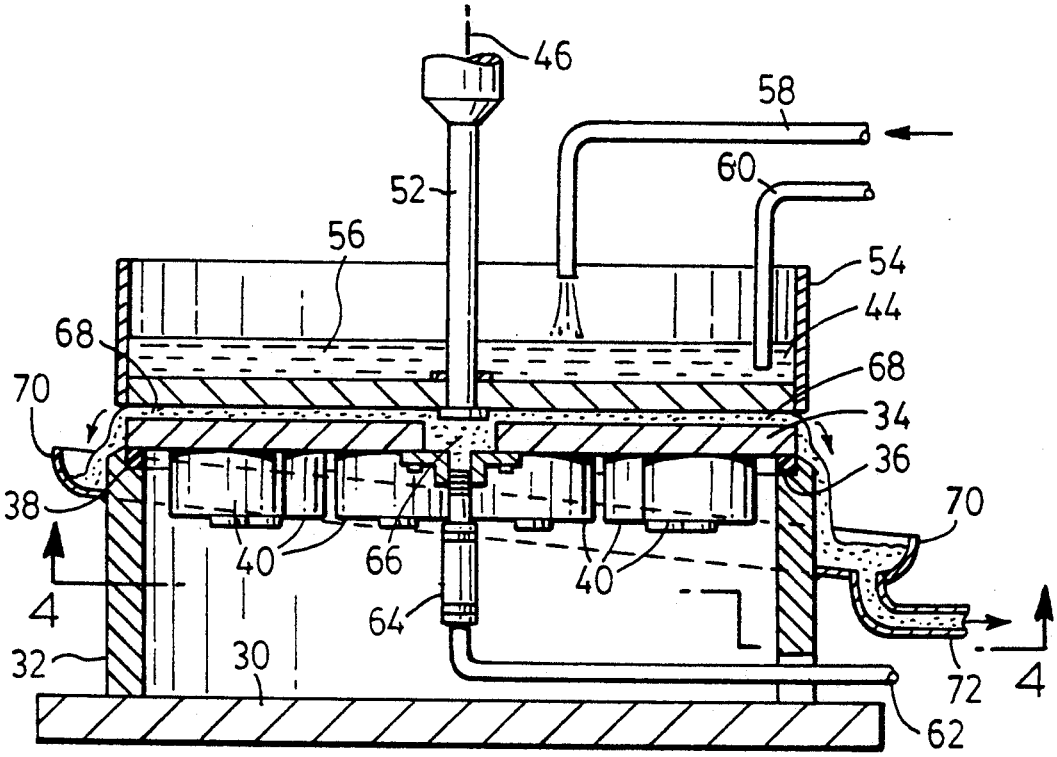
FIG. 3
FIG. 4
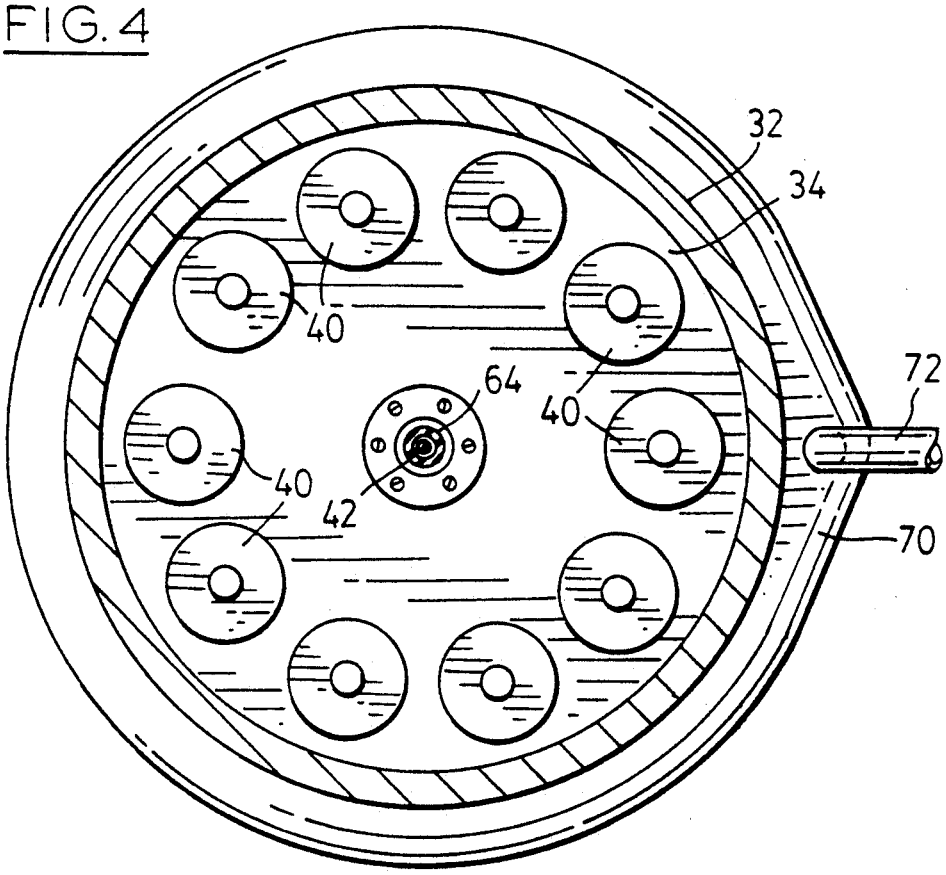

METHODS AND APPARATUS FOR TREATING MATERIALS IN LIQUIDS

FIELD OF THE INVENTION

The invention is concerned with methods and apparatus for treating materials in liquids, especially with methods and apparatus for mixing, or suspending, or dispersing, or dissolving, or deagglomerating, or comminuting materials, and more especially but not exclusively to such methods and apparatus employing finely divided ceramic materials in slurry suspensions thereof.

REVIEW OF THE PRIOR ART

Increasingly a number of manufacturing processes require the use of finely divided starting materials of, for example, particle size less than 5 microns, frequently of particle size less than 1 micron, and increasingly of particle size as small as 0.1 micron. This is particularly the case with processes for ceramics, where the use of very finely-divided raw materials makes it possible to produce articles having improved properties, such as improved strength, mechanical and thermal shock resistance, and of maximum or near maximum theoretical density after firing or sintering. The particle size distribution is also an increasingly important criterion, and particularly the requirement that all of the particles are of a size within a narrow range about the nominal value. In industrial practice the achievement of such uniformity of particle size is extremely difficult and considerably increases the cost of production.

For example, the manufacture of a ceramic part may require that the starting material be of average particle size 0.3 micron, with the expectation that the particle size distribution will have the typical bell-shape characteristic, i.e. the majority of the material (e.g. about 70% by weight) is of about the specified particle size, while small portions (e.g. about 15% each) are oversize and undersize, the maximum particle size being about 1.0 micron. Even though the material was milled by its manufacturer to be of that average size, it is unlikely that as received by its ultimate user it is still in the same state of fine division, since with all particles, and particularly such fine particles, agglomeration begins immediately the powder leaves the grinding mill, and this continues during subsequent handling. The materials are frequently pelletized to facilitate their transport and handling, and must subsequently be de-pelletized by grinding before they can be used. The result is that at least a portion of the material is outside the specified particle size range, and there is a high probability it includes a large number of particles which are so big that their presence causes defects in the resultant sintered product.

High speed stone (carborundum) and colloid mills are known for use in pigment dispersion in paints and consist essentially of two accurately shaped smooth stones working against each other, one of which is held stationary while the other is rotated at high speed (3600 to 5400 rpm) with a gap that is regarded by this industry as very small separating the two relatively movable surfaces. Thus, typically the spacing between the two faces is adjustable from positive contact to an appropriate distance, which with such mills is usually from a minimum of 25 micrometers to as much as 3,000 micrometers, but is usually of the order of 50–75 micrometers. In the typical stone mill the charge feeds through a truncated conical gap to the grinding region, which has the shape of a flat annular ring, while in a colloid mill the grinding region itself has the shape of a truncated cone. The dispersion of the pigment in its liquid vehicle is produced by the viscous laminar flow that takes place between the parallel faces of the stones as the material is fed into the gap by gravity, or under pressure. A separation gap of 75 micrometers is said to produce a particle dispersion having an average particle size of 2–3 micrometers, although the particle size distribution is not given, and substantially larger particles are certainly present.

SUMMARY OF THE INVENTION

It is a principal object of the invention to provide new methods and apparatus for the mixing, or for the suspension, or for the dispersion, or for the solution of gases and powdered materials in liquid vehicles, or for the deagglomeration, or for the comminution of powdered materials in slurry suspensions thereof.

It is a more specific object to provide such methods and apparatus that are particularly suited for the deagglomeration or comminution of very finely divided ceramic raw materials in slurry suspensions thereof.

In accordance with the present invention there is provided a new method for treating materials in liquids comprising the mixing of flowable materials, or the suspension or solution of gaseous or powdered materials in flowable liquid vehicles, or the deagglomeration and comminution of finely divided materials in flowable slurry suspensions thereof, the method comprising the steps of:

passing the material to be treated through a processing passage between two closely spaced surfaces provided by respective mill members, the passage having an inlet thereto and an outlet therefrom establishing a corresponding flow path between them through the passage;

while the material is passing in the processing passage moving at least one of the mill members so as to move the surfaces relative to one another in a direction transverse to the direction of the material flow in the flow path to subject the material to the effect of such relative movement; and at the same time applying longitudinal acoustic pressure oscillations so as to reverberate in the processing passage between the two closely spaced surfaces and so that the material in the passage is subjected to the effect of such oscillations and the reverberations.

Preferably the spacing between the mill member surfaces and their speed of relative movement is such as to produce "supra-kolmogoroff" eddies having Reynolds numbers greater than unity in the material passing between them, while the longitudinal pressure oscillations simultaneously reduce in the material "sub-kolmogoroff" eddies whose size is smaller than the smallest of the "supra-kolmogoroff" eddies.

Also in accordance with the invention there is provided new apparatus for treating materials in liquids comprising the mixing of flowable materials, or the suspension or solution of gaseous or powdered materials in flowable liquid vehicles, or the deagglomeration or comminution of finely divided materials in flowable slurry suspensions thereof, the apparatus comprising:

an apparatus frame;

first and second mill members mounted by the apparatus frame and providing respective first and second surfaces closely spaced from one another to form a processing flow passage between them for the flow therein of the material to be treated;

the passage having an inlet thereto and an outlet therefrom establishing a corresponding flow path between them through the passage;

motor means operatively connected to at least one of the mill members and moving the respective mill member so as to move the surfaces relative to one another in a direction transverse to the direction of flow of the material in the flow path to subject the material to the effect of such relative movement; and ultrasonic pressure generating means mounted on at least one of the mill members so as to apply ultrasonic pressure oscillations generated thereby into the processing passage transversely to the direction of flow of material in the flow path so as to reverberate in the passage.

DESCRIPTION OF THE DRAWINGS

Particular preferred embodiments of the invention will now be described, by way of example, with reference to the accompanying diagrammatic drawings, wherein:

FIG. 3 is a vertical cross section through the plate mill of FIG. 2, taken on the line 3—3 therein;

FIG. 4 is a horizontal cross section through the plate mill of FIG. 2, taken on the line 4—4 in FIG. 3;

FIG. 10 is a particle distribution cumulative graph showing as a solid line the particle distribution of a zirconia slurry before processing, and as a broken line the particle distribution after processing using the plate mill of FIGS. 2–4;

Similar or equivalent parts are given the same reference number in all of the figures of the drawings, wherever convenient. The spacings between certain surfaces of the mills are exaggerated for clarity of illustration.

DESCRIPTION OF THE PREFERRED EMBODIMENTS

Figure 1:
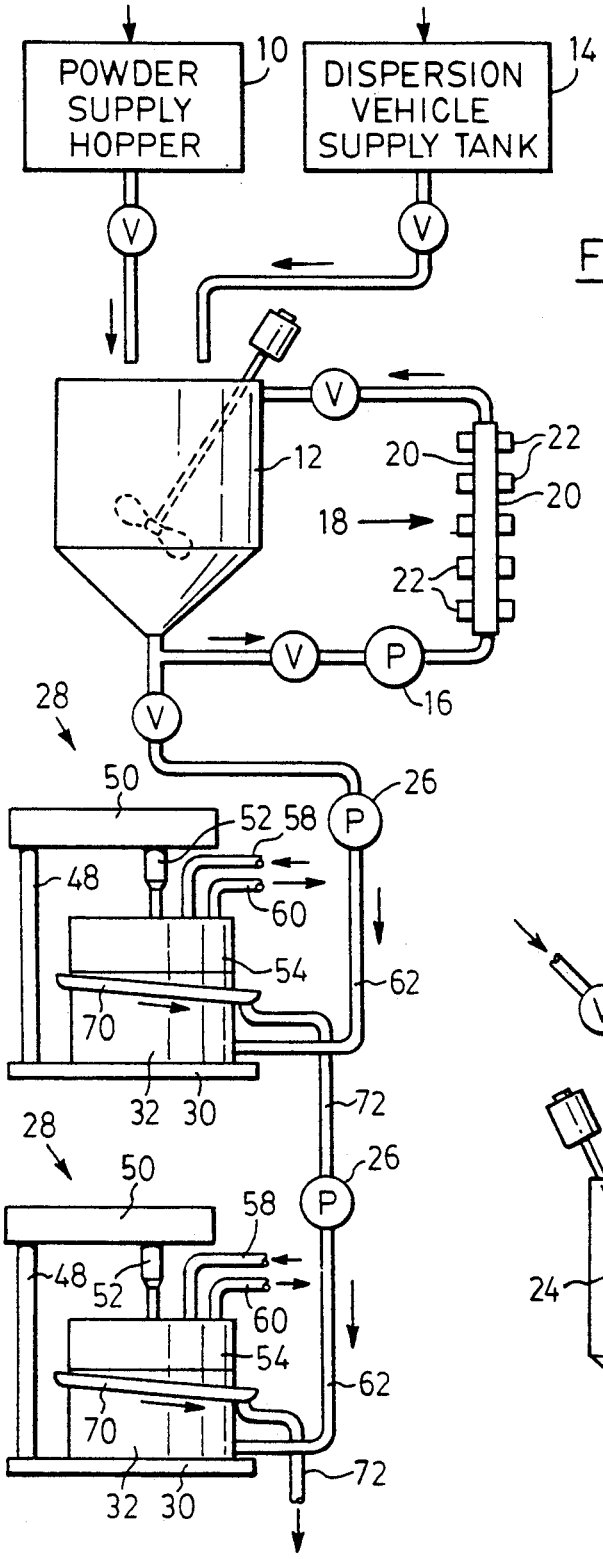
FIG. 1 is a schematic diagram of a continuously operating slurry milling system employing a plurality of plate mills of the invention connected in series, the system also comprising a single motionless reverbatory ultrasonic mixer in a recirculating premixing circuit that feeds the plate mills.

In the system illustrated by FIG. 1, in which finely divided powder is to be uniformly dispersed in a liquid vehicle and ground (with any necessary deagglomeration) to a smaller particle size, powder from a powder supply hopper 10 is fed to a mixing tank 12, while a dispersion vehicle is fed from a supply tank 14, a preliminary rapid coarse dispersion being obtained by circulating the mixture continuously in a closed circuit comprising the reservoir 12, a pump 16, and a high flow capacity motionless reverbatory ultrasonic mixer 18. Preferably the mixer 18 is of the type described and claimed in my prior U.S. Pat. No. 4,071,225, the disclosure of which is incorporated herein by this reference. Briefly, such a mixer comprises an elongated chamber of thin rectangular cross section having the two parallel longer walls formed by two flat, very closely spaced plates 20, each of these plates having a plurality of ultrasonic generators 22 mounted on its exterior so as to direct the ultrasonic pressure oscillations into the chamber and towards the opposite wall, the oscillations from the opposed generators interfering with one another in a manner which produces intense small eddies that are particularly effective to produce mixing and dispersion of the powder into the medium.

As is well known to those skilled in this art, the thorough dispersion of fine powders in a liquid dispersing vehicle using the conventional high shear mechanical stirring mixers, or ball and sand mills, is a lengthy and tedious process, often requiring several days to obtain an acceptable dispersion. There are a number of reasons for this, such as the increased surface area to be wetted resulting from the decrease in particle size, the inherent difficulty of wetting such fine particles, and the difficulty of deagglomerating the agglomerates that inevitably are present. A motionless reverbatory ultrasonic mixer such as that disclosed and briefly described above is able to produce acceptable dispersions in periods as short as 5–15 minutes, although with some processes it may be preferred to increase the mixing period to perhaps 30–45 minutes.

Although in this specific system a single reverbatory ultrasonic mixer is employed, if a completely continuous system is preferred the single mixer can be replaced with a series or cascade of such mixers of the necessary continuous flow capacity.

The dispersion vehicle, whether aqueous or non-aqueous, will most frequently include a dispersing agent or agents and usually will also include other functional additives, such as binders, plasticizers and lubricants. The relative proportions of the powder or powders, functional additives, and of the dispersion vehicle, are usually made such that the final dispersion is of minimum liquid content while giving a flowable slurry (which may be characterised as being "soup-like") capable of being circulated as described.

Figure 2:
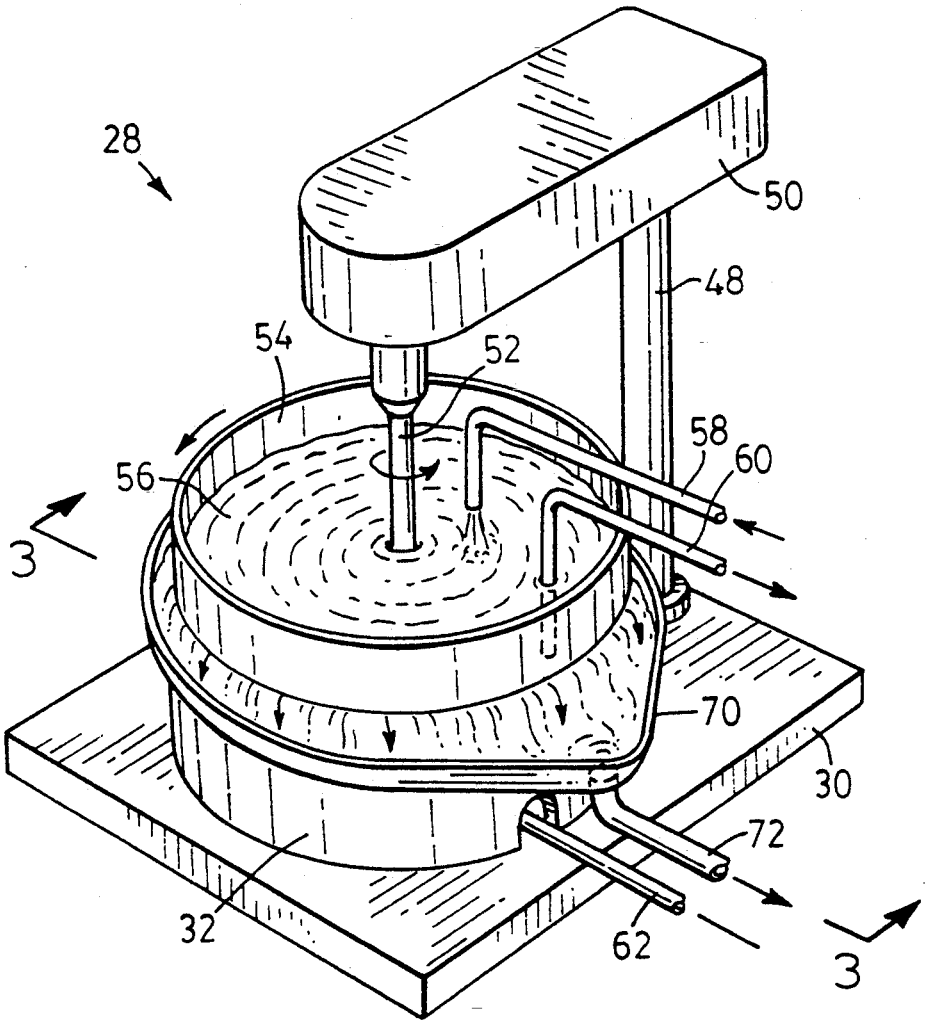
FIG. 2 is a perspective view from above and to one side of a plate mill which is a first embodiment, in which the mill plate members rotate relative to one another about a vertical axis.

Upon completion of this initial dispersion and mixing step the coarsely dispersed slurry is discharged to a holding tank 24 and fed from there via a pump 26 as a uniform continuous feed to a series or cascade of a plurality of plate mills 28 of the invention. A pump 26 is also provided between each successive pair of mills, so as to be able to control the rate and the pressure at which the slurry is fed to the respective mill. Referring now particularly to FIGS. 2–4, each mill comprises a baseplate 30 supporting a stationary cylindrical base member 32. A circular vibratory face plate member 34 is securely mounted on a ring or annulus 36 of resilient material, for example by being cemented thereto, and this annulus is in turn securely mounted in a counterbore 38, for example by being cemented therein, provided at the upper end of the cylinder 32, so that the plate is securely mounted on the base member. A small radial clearance is provided between the cylindrical edge of the face plate 34 and the facing cylindrical wall of the counterbore, so that the plate can vibrate freely vertically, but is constrained against any appreciable transverse motion. The plate is vibrated by a plurality of ultrasonic generators 40 attached to its underside and uniformly circumferentially spaced about the plate center point 42, the generators being connected to a suitable electrical power source (not shown).

A circular rotatable face plate member 44 is mounted above the plate 34 for rotation about a vertical axis 46 that passes through the center point 42 by drive means comprising a vertical standard 48 attached to the base plate 30. A motorised drive head 50 is mounted on the standard and has a drive shaft 52 extending vertically downward therefrom, the plate member 44 being attached to the lower end of the shaft at its respective center point, which also lies on the axis 46, so as to rotate therewith. The vertical height or spacing D (see FIG. 5) between the plate member surfaces, and consequently the vertical height of the flow passage, is accurately adjustable, either by moving the head 50 vertically on the standard, and/or by moving the shaft 52 vertically in the head, using any suitable micrometer system as will be well known to those skilled in the art. The plate member 44 is pressed strongly downwards, either by suitable spring or weight means applied via the drive head and the shaft 52, in order to maintain the small processing gap between the facing surfaces of the two plate members 34 and 44 at the desired value in the presence of the material flowing between them, as will be explained below. The operation of the mill generates sufficient heat that cooling greater than that which would be obtained by rotation of the plate 44 in air is desirable; to this end a cylindrical casing is attached to the circumference of the plate 44 and forms a coolant reservoir into which liquid coolant, such as cooled water, is delivered from a delivery pipe 58, and from which the coolant is removed by a pump (not shown) via an outlet pipe 60.

The predispersed slurry from the storage tank 24 is fed into the first mill 28 in the series via a delivery pipe 62, which includes a flexible connection 64 so as not to interfere with the vibrations of the plate 34. The slurry enters between the plate members through a cylindrical hole 66 in the center of the plate 34, this hole thus being the inlet to the processing flow passage 68 constituted by the corresponding circular space, the slurry flowing radially outwards in the treating zone constituted by the processing passage. Eventually the slurry reaches the circular outer edge of the plate 34 and the cylindrical gap between the adjacent plate edges constitutes the outlet from the passage; the slurry spills over the edge into a circular, upwardly open, downwardly inclined, collection trough 70, this trough completely surrounding the stationary base member 32 and delivering the slurry to the succeeding pump 26, and thus to the succeeding mill 28.

During its flow in the passage 68 the slurry is subjected both to the effect of the relative rotation between the two plate members, and also to the effect of the longitudinal pressure oscillations or vibrations from the generators 40, these effects combining as will be discussed below to produce within a much reduced period of time a much more complete dispersion and wetting of the solid powdered material entrained in the slurry, together with the desired deagglomeration and comminution thereof, than has been possible with conventional high shear mixers.

Typical fine powder materials that will be processed using the apparatus of the invention are alumina, silica and zirconia, all of which are available commercially as agglomerated primary particles of 5 micrometers or less, and particularly are available as agglomerated primary particles of the nominal size range 0.3–1 micrometer. The quantities of the powdered material and the functional additives that are introduced into the dispersion vehicle will of course depend upon the purpose of the slurry, but usually it is desired to keep the quantities of both the dispersing vehicle and the additives as low as possible to facilitate subsequent processing. Its consistency needs to be kept relatively "soup-like" to permit its free flow through the relatively narrow flow processing passages 68 of the mills, and a viscosity in the range of about 10–100 centipoises will usually be satisfactory.

In that this embodiment of the invention employs two relatively rotating plates as the mill members it is referred to herein as a plate mill, and in a particular preferred embodiment the two plate members are both of 25 cm (10 ins) diameter and of 6.25 mm (0.25 in) thickness and are of silicon carbide, preferably diamond coated on their facing surfaces, both surfaces having a mirror finish and in this embodiment preferably being flat to a limit of 500 nanometers over 25 cms. Flatter surfaces are possible, but in this particular embodiment are not necessarily economical or essential. The range of flatness preferred for the apparatus of the invention, depending upon its particular application, is from 5 nanometers to 10 micrometers per 25 cm. The diamond layer can be either crystalline or amorphous, and is applied by ion implantation, or by similar methods which by the nature of the process will replicate the original flatness of the base plate.

The maximum height of the vertical gap D between the two plate surfaces is of course indefinite, since they will usually need to be separated for maintenance and inspection, while the minimum height during operation will be as small as 1 micrometer or less, which is the processing gap that will usually be required for processing the smallest particle size slurries, while permitting an adequate flow of slurry between the plates. In normal operation the processing gap size is correlated with the average particle size of the slurry, and in a series of mills will be progressively smaller from the first to the last mill. The range of gap sizes to be employed is from 1 to 500 micrometers, while the usual range of gap sizes for the processing of powdered materials is 1–10 micrometers; the preferred range, especially for the processing of ceramic raw powders is 1–5 micrometers. As described above, the processing gaps shown in the embodiments illustrated herein are not to scale, but are exaggerated for clarity of illustration. The processing of any particular slurry will usually involve a particular protocol which inter-relates the process time and the passage height of the successive mills; thus the process is initiated in the first mill in which the plates are relatively far apart in case any exceptionally large agglomerates are present, and the spacings in the subsequent mills are progressively reduced as the process continues and the particle size is reduced. It will usually be most effective to operate an individual mill with a relatively limited particle size range, and for example a mill with a feed in the range 0–100 micrometers will be employed to produce a product in the range 0–1 micrometer, (0–1,000 nanometers), while one with a feed in the range 0–1.0 micrometer will be employed to produce a product in the range 0–0.2 micrometer, (0–200 nanometers). Similarly, a mill with a feed in the range 0–0.2 micrometers will be employed to produce a product in the range 0–0.08 micrometer, (0–80 nanometers).

With such small gaps between the relatively moving members it is found that the viscosity of the flowable material is the controlling factor in the movement of the material through the processing gap. Thus the material clings to the two surfaces in the form of respective boundary layers, and they are so closely spaced that they engage one another without the presence of any intervening layer, the layer adhering to the moving plate is therefore dragged in contact with that contacting the stationary plate, and it is therefore this relative motion between the two surfaces that controls the flow of material in the processing passage. The thin layers between the plate members that are characteristic of the invention require the plate members to be relatively rigid and to be pressed strongly together in order to maintain them. The close spacing and thin layers also permit the quick and effective grinding of any very large particles that are present in the material, and this grinding action is also facilitated by the strong pressing of the plates toward each other. It is an advantage of the methods and apparatus of the invention that, owing to the much smaller processing gap, as compared for example to my own motionless reverberatory ultrasonic processor, or the high speed stone and colloid mills described above, it is no longer necessary to provide oscillators on both surfaces of the processing passage in order to obtain reverbatory action and sufficient intensity to obtain "sub-kolmogoroff" eddies. This permits simplification of the construction of the mill and avoids the need to provide oscillators and an electrical supply to the moving plate member. The size, number and spatial distribution of the ultrasonic generators 40 will of course be specific for the particular mill, and as a specific example only, in the mill described herein ten transducer generators are provided uniformly spaced in a single circle, each generator having an output of about 50 watts and operating with a range of frequencies 30 kHz to 50 kHz, which is the preferred range. The usual more extended range that will be used, depending upon the specific mill design, will be 8 kHz to 100 kHz.

As was described above, it is well known to those skilled in the art of the production of slurries of ceramic materials that with small particles, even with high-power, high-shear mixers a relatively long period of "aging" is required to obtain complete dispersion, and this period is not shortened appreciably by increases in mixing power or in the shear velocity, the latter being produced by increasing the speed of rotation of the stirrer. A study by Dr. A.N. Kolmogoroff of such mixing processes gave what appears to be a possible explanation for the known fact that initially mixing proceeds rapidly, but then slows dramatically. He showed that the mixing depended upon the production of eddies, and that with conventional mixers using, for example, water as the dispersion vehicle and at a process temperature of 20° C., it was impossible to obtain eddies of diameter less than about 10 to 20 micrometers. Liquid elements of smaller size than this became part of these smallest eddies and were shielded against the effect of turbulence, so that mass transfer would no longer be governed by convection but by the much slower molecular diffusion as a result of the concentration gradients. The smallest Kolmogoroff eddy that can be produced by these mixers is obtained when the Reynolds number approaches unity. This therefore explained the need for an "aging" period, during which this slower molecular diffusion could take place, and why it was not possible to reduce the overall time appreciably by increase in stirring power or shear velocity.

There have been numerous proposals for the use of longitudinal pressure oscillations in various processes and apparatus, many of which have not proven to be commercially feasible owing to the high exponential attenuation (1/D, where D = vessel diameter or wall distance) of such oscillations. The eddies or vortices produced by such oscillations can be made to be much smaller than those produced by high shear mixers, increasing the rate of mass transfer with system elements in the micron and sub-micron ranges, but apparatus in which the oscillations are applied to a liquid or slurry moving in a channel with stationary walls, such as in the motionless reverbatory mixer 18, have been found to have their own problems, especially with small particle slurries. It has been found difficult to space the vibrating walls apart less than a few millimetres, and to maintain the opposed walls with uniform spacing as they are vibrated, but unless the walls are very closely spaced insufficient sound intensity is generated. Very close wall spacing in turn has been found frequently to produce oscillations which cause agglomeration instead of deagglomeration. Furthermore, high velocity eddies with Reynolds numbers larger than unity ("supra-kolmogoroff" eddies) of the type provided by mechanical high shear mixers were infrequent. It is further found that the walls tend to deform in shape with time, and that it is difficult to arrange for their adequate cooling without interfering with the placement and operation of the transducers or oscillators. An additional unexpected difficulty is that the moving fluid often "channels" in its flow through the passage, thus receiving non-uniform treatment.

The methods and apparatus of the present invention make use of the discovery that fine particle fluids and slurries can be more efficiently treated by a combination of "macromixing" the flowable material between two relatively moving surfaces, which surfaces are sufficiently closely spaced and are moved relative to one another at sufficient speed to produce "supra-Kolmogoroff" eddies, and simultaneously "micromixing" by the application of the reverberatory longitudinal pressure oscillations between the moving closely spaced surfaces via at least one of the surfaces to simultaneously produce "sub-kolmogoroff" eddies which are smaller than, and are able to interact with, the smallest of the "supra-kolmogoroff" eddies for an unexpected synergistic and beneficial effect in mixing, dispersing, comminuting, deagglomeration, etc. Thus, in this embodiment the surfaces of the two discs 34 and 44 are moved relative to one another transverse to the direction of material flow at a distance apart sufficiently small, and a rotational speed sufficiently high, to produce these "supra-kolmogoroff" mixing eddies in the narrow passage 68, while at the same time reverberatory longitudinal pressure oscillations of the required high frequency and power are applied to produce the much smaller "sub-kolmogoroff" eddies required to penetrate and interact with the "supra-kolmogoroff" eddies in order to reach and affect the small particles entrained in the fluid. This close spacing and relative movement of the surfaces is also required to ensure that the longitudinal oscillations do not instead cause agglomeration of the particles, instead of the required deagglomeration.

Thus, although it is well known that as a fluid flows in a passage the velocity gradient across the passage cross section is non-uniform, being smallest in the boundary layers at the surfaces and increasing towards the center of the cross section, it has not to my knowledge been realized that by causing relative movement of closely spaced passage wall as in a mill of the invention, controlled "supra-kolmogoroff" eddies can be generated extending transversely, circumferentially and radially in the otherwise laminar flow in the boundary layers, producing "macro" mixing of the fluid, into which can be added the "micro" mixing provided by the "sub-Kolmogoroff" eddies available by the action of the longitudinal pressure oscillations.

Another effect obtained with the mill of the invention is a mechanical crushing of any particles larger than the passage height, the relative parallel movement of the walls ensuring that such particles cannot become jammed in the passage and eventually begin to block it, or prevent further closing of the plates together without damage to their surfaces. The mechanism by which the vertical pressure is applied can also operate to prevent jamming if grossly oversize particles are inadvertently present. A further effect of the relative movement is that it supplements the pressure applied to the slurry by the circulating pump to enable the mill to treat slurries that are thicker and of considerably greater viscosity than would be possible in its absence; this is especially important with ceramic slurries that are eventually to be molded and where the minimum amount of suspension vehicle is used.

With the mill described, since the two plates rotate relative to one another, the relative circumferential linear transverse movement between them will vary progressively from zero on the rotational axis to a maximum at the circumferences, so that a preferred minimum threshold value for such movement will only be obtained at some radial distance from the axis. For the 25 cm (10 ins) diameter plates used in this embodiment the linear velocity of their operative surfaces relative to one another should be between 0.5 and 2000 meters per minute (20 and 80000 inches per minute) and with a rotary structure such as that described it will depend upon the rate of rotation of the upper plate; in this specific embodiment measured at a mean radius of 6 cm (2.5 ins) this should be between about 1 and 400 revolutions per minute, while the preferred rate is between 50 and 200 revolutions per minute.

Figure 5:
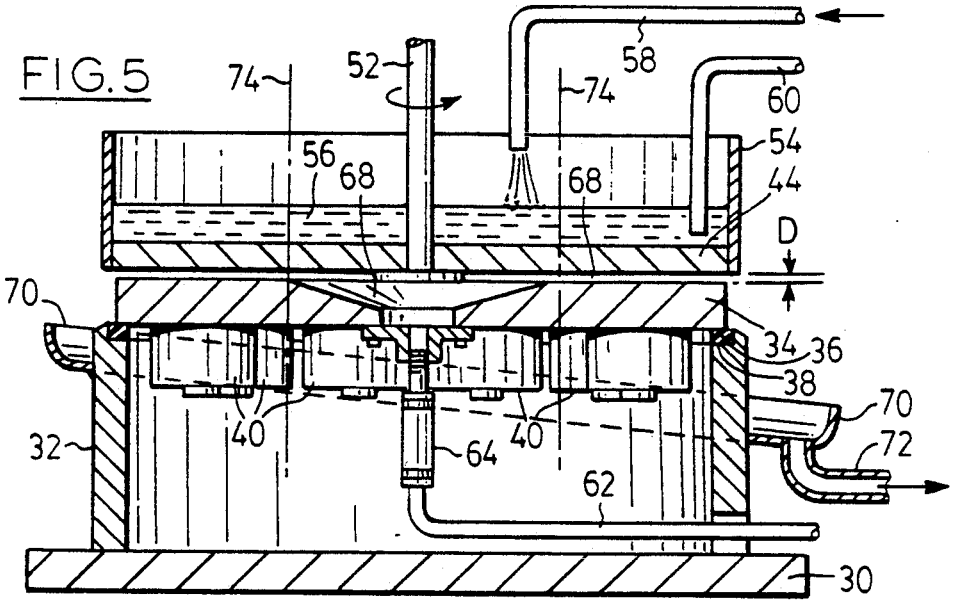
FIGS. 5 through 7 are simplified partial transverse cross sections similar to FIG. 3 to illustrate different embodiments.

There is therefore the possibility of decreasing the cost of the plates 34 and 44 by forming the highly polished and flat operative surfaces only at their annular outer portions, and an embodiment taking advantage of this is illustrated by the simplified FIG. 5, in which only essential elements are shown. The hole 66 in the plate 34 has been extended radially and the facing surfaces are only fully finished between the cylindrical plane 74 and the outer circumferential plate edges.

Figure 6:
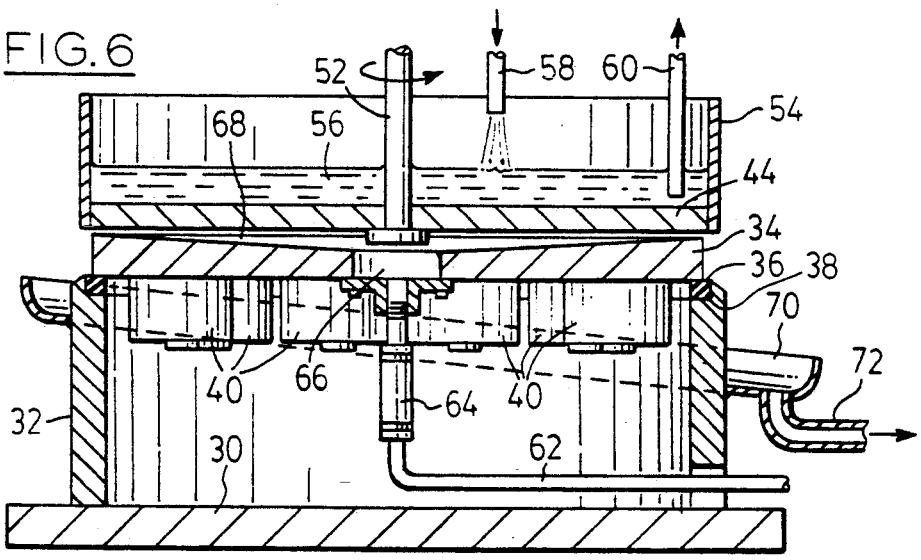

In another embodiment illustrated by FIG. 6 at least one of the facing surfaces of the plates (the surface of the plate 44 in this embodiment) is formed to provide the flow path gap 68 so that it decreases progressively in height from the center radially outwards. The annular shaped radially outer portion of the flow passage where the passage walls are sufficiently closely spaced therefore constitutes a treating zone in which the required action takes place. Such a mill in which the slurry is to be processed in a single pass will have the gap at the center of the maximum value required to process the material, while the gap at the circumference is the minimum value for this purpose.

Figure 7:
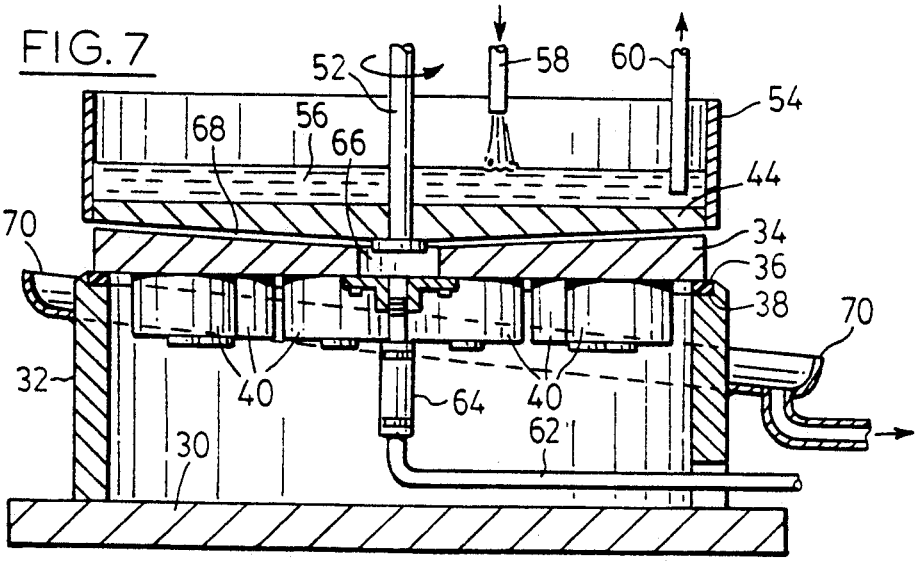

FIG. 7 illustrates an embodiment in which the two plate surfaces are conical with both pieces pointing downward; with such a structure the material must move upward against gravity in its flow through the passage, helping to ensure that the material is fully treated.

Although the method and apparatus of the invention have been described in their application to the treating of ceramic slurries, it will be apparent that they are applicable generally to the mixing of materials, such as the mixing of two mutually non-soluble or difficultly soluble liquids, the solution of materials in liquids, particularly fine particle materials and materials that are of low solubility in the liquid, and the suspension of other materials in suspension vehicles, especially materials that are difficult to wet, and particularly fine particle materials.

Figure 8:
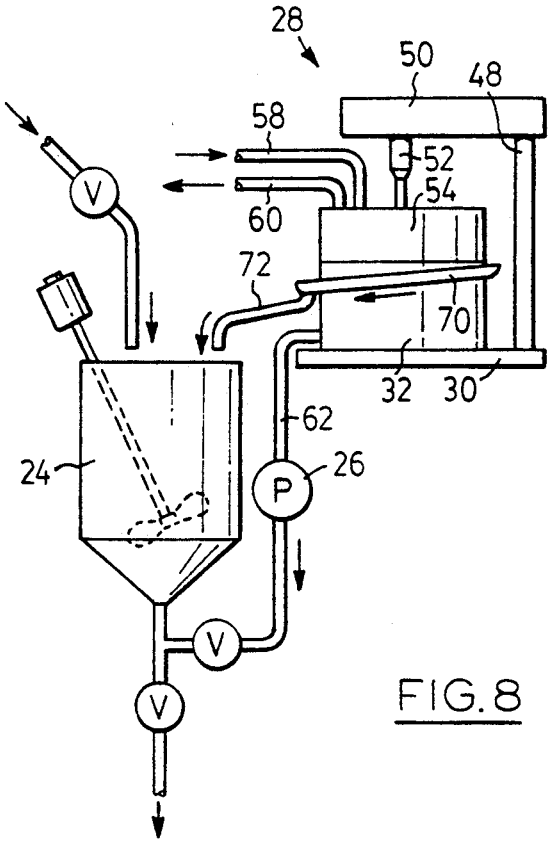
FIG. 8 is a part schematic diagram to illustrate a batch processing system employing a single plate mill through which the slurry is recirculated in a corresponding circuit.

FIG. 8 illustrates the manner in which a single mill of the invention is used in a closed recirculating circuit to operate in a batch process. The premixed slurry is fed from the tank 12, as with the process of FIG. 1, to the holding tank 24 and is delivered by the pump 26 to the mill inlet pipe 62. The mill outlet pipe 72 however discharges back to the tank 24, and the slurry is recirculated until the desired particle size distribution has been obtained. The batch process may be operated in accordance with a predetermined protocol whereby the mill plate members are spaced apart the maximum operative distance at the start, and are moved together, either progressively or stepwise, as the process proceeds until at its conclusion they are at the minimum operative spacing.

Figure 9:
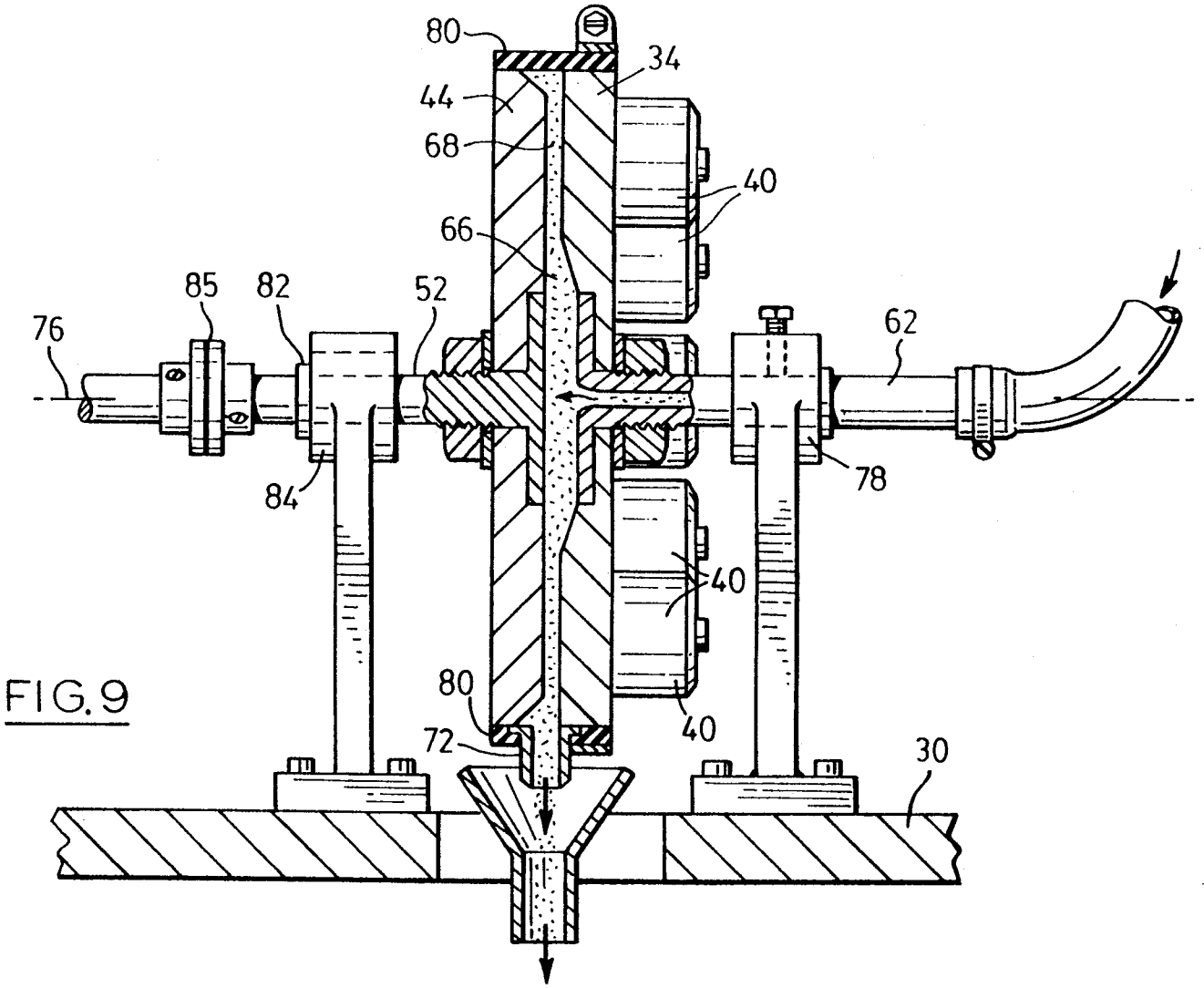
FIG. 9 is a longitudinal cross section similar to FIG. 3 of a plate mill which is another embodiment of the invention, the mill plate members rotating relative to one another about a horizontal axis.

FIG. 9 is a longitudinal cross section through another plate mill embodiment in which the two plate members are mounted for rotation about a horizontal axis 76. The stationary vibratory plate member 34 is securely fastened in the required orientation at the upper end of a standard 78 mounted on the baseplate 30 and has a cylinder 80 of resilient material fastened to its cylindrical periphery. The inside surface of this resilient cylinder is in close rubbing contact with the corresponding cylindrical periphery of the rotatable plate member 44, so as to seal the cylindrical periphery of the flow path 68, except for a discharge nipple 72 at its lowermost part, this nipple constituting the outlet from the path. The shaft 52 mounting the movable plate about the horizontal axis 76 is mounted in a bearing 82 at the upper end of a standard 84 mounted on the baseplate 30 and is driven by a motor (which is not shown) via a coupling 85, which permits the necessary movement of the shaft and the plate along the axis 76 to vary the flow path height and to permit access to the space 68 as required.

This embodiment has the advantage that there is less exposure to the air of the emerging processed slurry, in that it can flow from the nipple 72 directly to the inlet of the next mill.

FIG. 10 is a combined cumulative graph showing the particle size distribution of a slurry material prior to its processing in the mill of FIGS. 2–4, this particular characteristic being shown in solid lines. The material employed was a spray dried, partially stabilised zirconia of nominally 0.3 micrometer particle size that had been pelletized using a water soluble binder to prevent dusting and to permit its ready transport, the pellets being of 100–150 micrometer size. Fifty (50) grams of these pellets were predispersed for 30 minutes in 100 grams of water with a small amount of a surfactant (0.3% by weight of the zirconia) using an ultrasonic horn, which should have been sufficient to fully deagglomerate the raw powder. The characteristic shown as a solid line is that of the material after processing with the horn, but before processing in the plate mill of the invention, and it will be seen that only 82% is of a size smaller than 0.8 micrometers, there is virtually no material of size between 0.8 and 10 micrometers, and the remaining 18% is of size between 10 and 80 micrometers. This is partly the result of agglomeration, but mainly the result of hardening of the pellets, making them difficult to restore to the original particle size without a complete expensive remilling of the material. The characteristic in broken lines is the result of the same test on material that has been processed in the plate mill of the invention for a period of 30 minutes; it will be seen that all of the material is below 0.8 micrometers, 99.25% is below 0.7 micrometers, and 96% is below 0.6 micrometers, and the material now shows an excellent typical symmetric bell curve distribution about a median value of about 0.36 micrometers.

Figure 11:
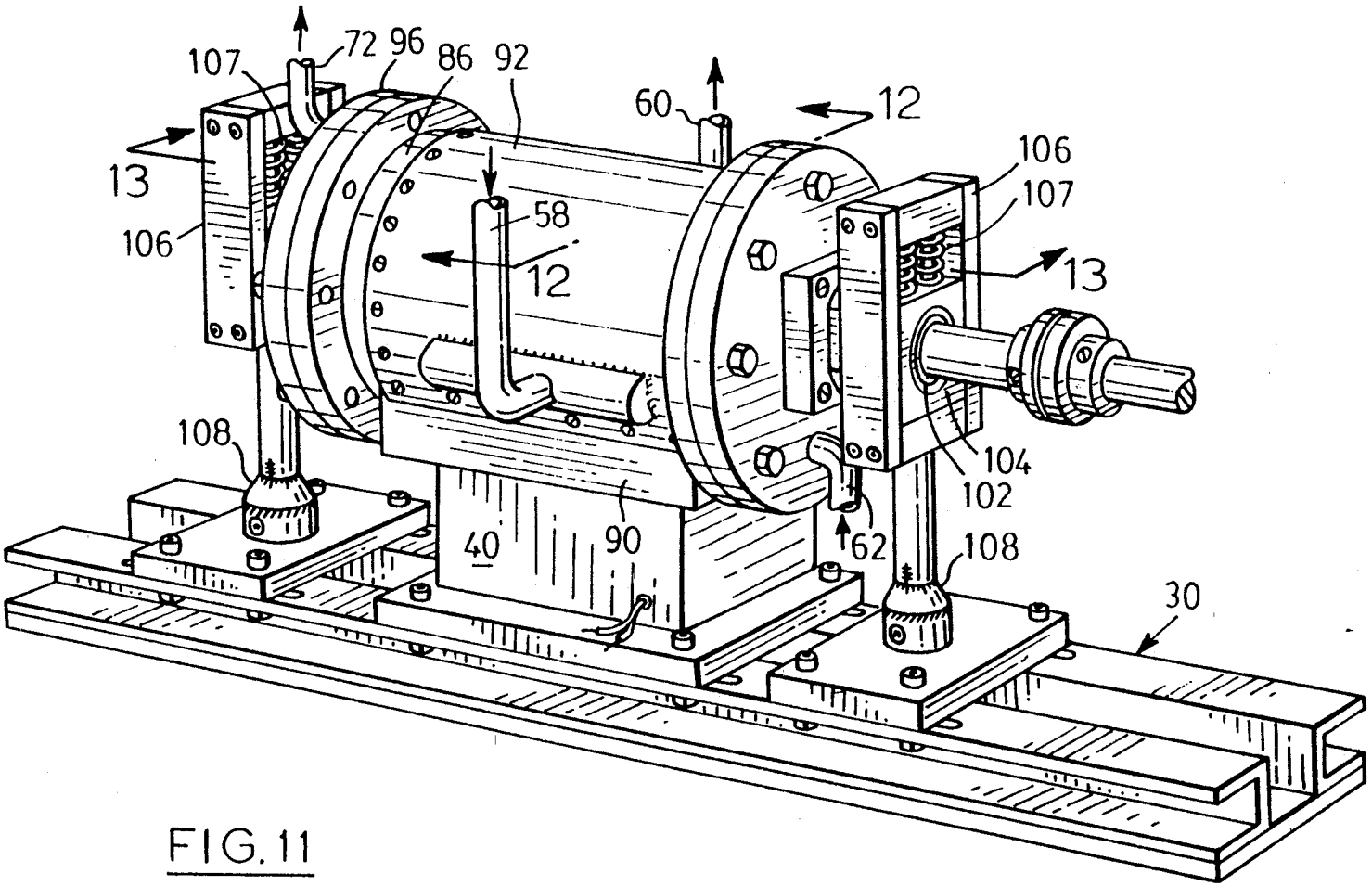
FIG. 11 is a perspective view similar to FIG. 2 of a roll mill which is a further embodiment and in which the mill members comprise a solid inner cylinder within a hollow outer cylinder, the cylinders rotating relative to one another about a horizontal axis.
Figure 12:
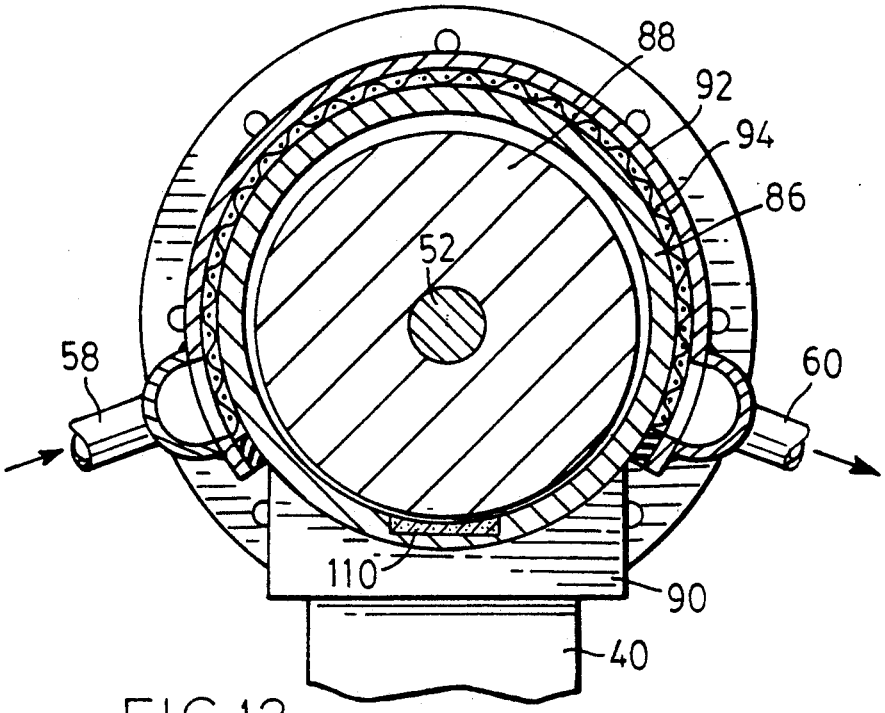
FIG. 12 is a transverse cross section through the roll mill of FIG. 11, taken on the line 12—12 therein.
Figure 13:
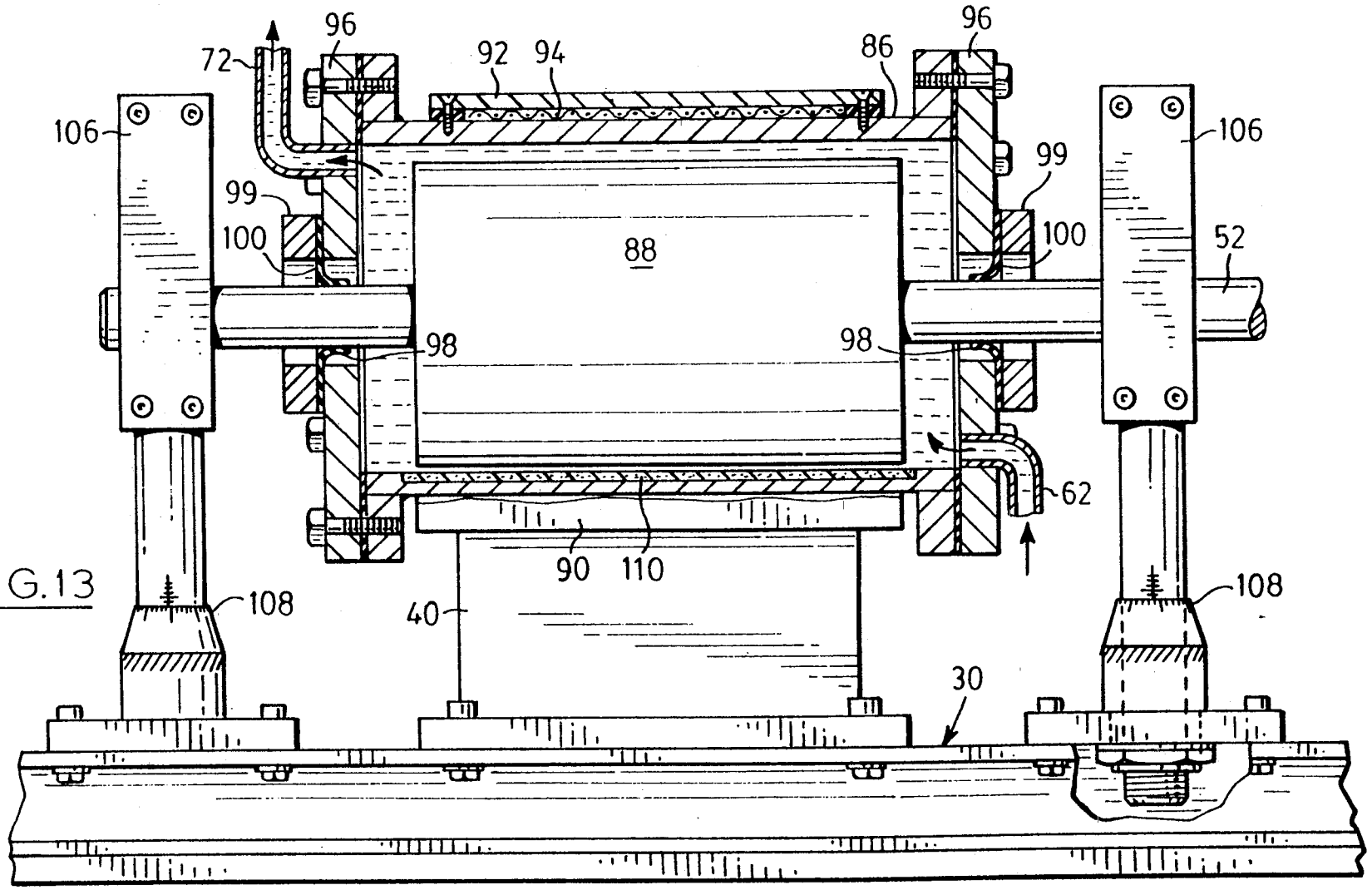
FIG. 13 is a longitudinal cross section through the roll mill of FIG. 11, taken on the line 13—13 therein.

In the embodiment of FIGS. 11–13 the stationary plate member 34 is replaced by a stationary outer hollow cylinder 86, while the rotary plate member 44 is replaced by a solid inner cylinder 88 mounted for rotation about a horizontal axis 76 within the hollow cylinder, the flow path 68 being constituted by the annular space between their respective outer and inner surfaces. Such a mill is referred to herein as a "Roll" mill. The single ultrasonic generator 40 that is provided is mounted directly on the mill base 30, and supports the outer cylinder 86 via an intermediate coupling member 90. As much as possible of the remainder of the exterior of the outer cylinder is enclosed by a cover plate 92, and the space between the cover plate and the cylinder 86 is filled with wire mesh 94, thus forming a part annular enclosure for the passage of cooling water that enters through inlet 58 and leaves through outlet 60. The wire mesh increases the cooling efficiency of the enclosure by increasing the effective contact of the cooling vehicle with the cylinder outer wall.

The interior of the outer cylinder is closed by two circular end cover plates 96 attached to respective flanges at the ends of the cylinder, one of the cover plates mounting the slurry feed pipe 62 at its lowermost point, while the other mounts the slurry discharge pipe 72 at its uppermost point. The two cover plates are provided with aligned vertically elongated holes 98 through which pass the shaft 52 on which the solid inner cylinder 88 is mounted, the holes thus permitting vertical movement of the shaft and the inner cylinder for adjustment of the gap between the lowermost part of the inner cylinder external surface and the corresponding lowermost part of the internal surface of the of the outer cylinder. Each cover plate carries a respective slotted guide member 99 through which the shaft passes in order to permit the shaft to move vertically in order to vary the eccentricity of the relative rotation of the two cylinders, while constraining the shaft for such vertical movement. Two annular gasket seals 100 are sandwiched between their respective cover plate and the butting outer cylinder flange and closely embrace the shaft 52 to prevent escape of slurry through the elongated holes 98. The shaft is mounted for rotation about the horizontal axis 76 by two taper roller bearings 102, each of which is mounted in a respective housing 104 mounted and constrained for vertical sliding movement only in a respective cage 106. Each bearing housing is urged to the bottom of its respective cage by compression springs 107, and each cage is mounted on the mill base 30 via a micrometer shaft 108, so as to permit the position of each cage above the base, and thus of the shaft 52, to be accurately adjusted as required.

The inner cylinder 88 preferably is entirely of a sufficiently hard material, such as silicon carbide, with its external surface ground accurately and smoothly to the required limits. The outer cylinder can also be of the same material, but for economy can be of stainless steel with an insert 110 of the same material as the inner cylinder over its lowermost arc where the processing gap is formed and the grinding and milling action takes place, the inner milling surface of the insert being ground to the necessary profile and smoothness. In a specific embodiment the inner cylinder is of 15 cm (6 ins) length and diameter and is rotated at speeds in the range 200–2000 rpm, preferably 400–600 rpm. The circumferential extent of the insert 110 is about 2.5 cm (1 in) and the gap between its inner surface and the outer surface of the inner cylinder 88 will vary in the range 1–500 micrometers, preferably in the range 1–100 micrometers. The diametrically opposed gap at the uppermost parts of the two cylinders has a maximum value of about 5 mm (0.20 in).

This embodiment also functions by surface action or "skin-drag" of the rotating outer surface of the inner cylinder 88, which captures the slurry as a boundary layer and drags it with it into engagement with the boundary layer that is present on the surface of the insert 110, this also producing the desired "supra-Kolmogoroff" eddies in the milling gap between the relatively moving cylinders, while the accompanying "sub-Kolmogoroff" eddies are produced by the ultrasonic transducers in the gap, so as to again permit the milling of the particles to sub-micron values. The rate of flow of the slurry through the mill is made such that all of it will be dragged by the rotating surface of the inner cylinder through the milling gap, despite the presence of the larger gap at the upper part of the mill, which may appear from the drawing as though it would short circuit the milling gap; however, as explained above, in this embodiment the maximum value of this gap is only 5 mm, and is more usually of the order of 1 mm, and this is sufficiently small to ensure that with the correct choice of flow rate the desired passage of all of the material through the processing gap will be achieved. If there is any doubt in this regard, or if a particular mill is to be operated with a flow rate sufficiently high for some bypass to be possible, then all that is needed is a circumferential seal intermediate the ends of the cylinders, either on the moving or the stationary cylinder, and extending into contact with the other cylinder. As with the other embodiments the milling surfaces are self-grinding and self-polishing and the "drum" structure is not only less expensive to produce but gives greater possibility of accurate control of the milling gap. It also may differ in its action from the plate mill in that the processing gap is usually sufficiently small for the two boundary layers to inter-engage with one another, while the opposite gap is usually large enough for an intervening layer to be present, so that a cycle is produced as the cylinder rotates of the establishment and removal of the intervening layer, this facilitating production of "supra-Kolmogoroff" eddies. It will usually be preferred to use a plate mill when the circumstances require the maximization of uniform "sub-Kolmogoroff" mixing, while it will be preferred to use a roll mill when the circumstances require the maximization of comminution.

Figure 14:
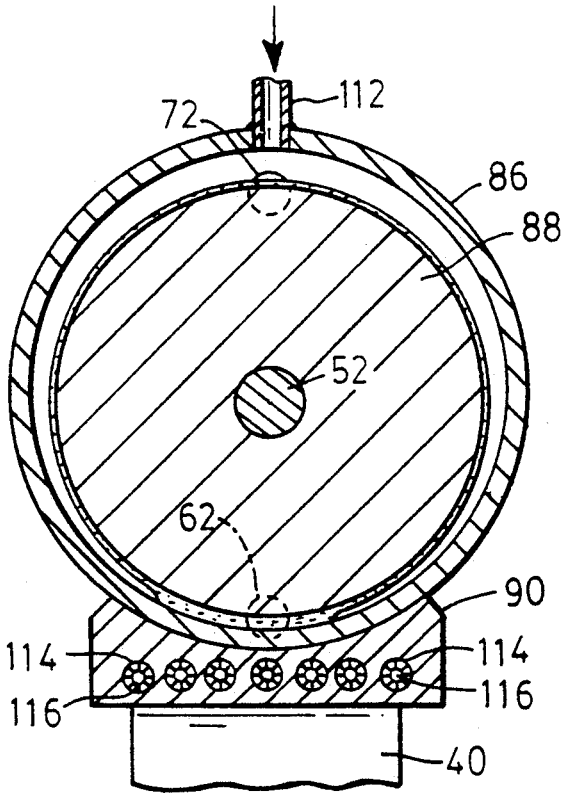
FIG. 14 is a longitudinal cross section through a roll reactor in accordance with the invention, also comprising inner and outer cylinders that rotate relative to one another about a horizontal axis.

FIG. 14 shows apparatus according to the invention for carrying out otherwise difficult to perform chemical reactions and physical inter-actions, depending upon the formation of "sub-Kolmogoroff" eddies, such as the reaction of a gas with a liquid, or the rapid solution or reaction of a difficultly soluble gas in or with a liquid, or the solution of a difficultly soluble solid material in a liquid. This apparatus also consists of an inner cylinder 88 rotating about a horizontal axis within a hollow outer cylinder 86. The liquid to be reacted, or to act as the solvent, is fed through the reactor from a liquid inlet 62 at one end to a liquid outlet 72 at the other end, both the inlet and the outlet being disposed at the lowermost part of the outer cylinder, while the other component is fed into the action/reaction space between the two cylinders by an inlet 112, no separate outlet of course being required since it is being consumed by the liquid. The coupling member 90 is provided with passages 114 for cooling or heating liquid, depending upon whether the action/reaction taking place in the reaction gap is exothermic or endothermic, these passages being provided with heat exchange enhancing inserts, as disclosed for example in my U.S. Pat. No. 4,784,218, the disclosure of which is incorporated herein by this reference. The liquid component is fed at a rate to ensure that the pool formed is confined to the space between the relatively rotating members immediately adjacent to the ultrasonic transducers.

The reaction gap can be of greater height than the grinding gap of the previously described embodiments and can be in the range from 1 micrometer to 5 mm, while the opposite gap can be in the range from 2 mm to 2 cm. The rate of relative movement of the two surfaces will also usually be much higher and, for example, with an inner cylinder of 15 cms (6 ins) diameter the rotational speed will usually be in the range 200 to 20,000 rpm, with a preferred range of 500–10,000 rpm. The highest possible speed is usually to be preferred, in that thinner more active films are produced on the inner cylinder outer surface, but an upper limit can be set by the possibility that the resultant centrifugal force completely disrupts the film.

Although in the embodiments described the inner cylinder 88 is solid, it can instead consist of a hollow cylinder provided with a suitable internal structure by which it is mounted for rotation about the horizontal axis.

I claim:

1. A method for treating materials comprising flowable slurry suspensions of powdered materials in liquid vehicles, the method comprising:

passing the material to be treated in a flow path constituted by a passage between two closely spaced passage surfaces provided by respective mill members, the passage having a passage inlet thereto and a passage outlet therefrom, the material passing through the flow path in a corresponding flow direction;

the spacing between the passage surfaces decreasing from the passage inlet to a treating zone in which the spacing between the passage surfaces is sufficiently small that the boundary layers of the material at the treating zone passage surfaces intercept one another without an intervening material layer;

while the material is passing through the flow path moving at least one of the mill members so as to move the passage surfaces relative to one another in a direction transverse to said flow direction at a relative speed such that supra-Kolmogoroff eddies are produced in the intercepting boundary layers; and applying longitudinal acoustic pressure oscillations to the material in the treating zone between the two relatively moving closely spaced passage surfaces so as to produce therein sub-Kolmogoroff eddies of size smaller than said supra-Kolmogoroff eddies.

2. A method as claimed in claim 1, wherein the mill members are circular plates mounted for rotational movement relative to one another about a common rotational axis passing through their centers, the passage surfaces being constituted by respective opposed surfaces of the two plates, and wherein the plates are also mounted for movement relative to one another along the rotational axis to vary the distance between the two opposed surfaces.

3. A method as claimed in claim 2, wherein one of the circular plates is stationary and the other is rotatable, wherein the stationary plate has ultrasonic transducers mounted on its circular side opposite to the side providing the respective passage surface to produce the ultrasonic reverbatory pressure oscillations, and wherein the rotatable plate comprises means for cooling it and thus cooling the material passing in the flow passage.

4. A method as claimed in claim 1, wherein the mill members are respectively a stationary hollow outer cylinder, and a rotatable inner cylinder mounted within the stationary hollow outer cylinder for rotation about a respective longitudinal rotational axis, and wherein the two cylinders are also mounted for movement relative to one another transverse to the rotational axis to thereby vary the spacing between the two opposed flow passage surfaces.

5. A method as claimed in claim 1, wherein the mill members are moved so as to produce a linear velocity between the closely spaced passage surfaces relative to one another between 0.5 and 200 meters per minute.

6. A method as claimed in claim 1, wherein said passage surfaces of the mill members have a surface flatness in the range 5 nanometers to 10 micrometers per 25 cm.

7. A method as claimed in claim 1, wherein the material to be treated is circulated between the passage and a reservoir for the treated material.

8. A method as claimed in claim 1, wherein the material to be treated is circulated between the passage and a reservoir for the treated material while the height of the passage is reduced.

9. A method as claimed in claim 1, wherein the material to be treated is pretreated in a motionless reverbatory ultrasonic mixer before being passed in the flow passage.

10. A method as claimed in claim 1, wherein the spacing between the closely spaced passage surfaces is in the range 1-500 micrometers.

11. A method as claimed in claim 1, wherein the closely spaced passage surfaces have a mirror surface finish or better.

12. Apparatus for treating materials comprising flowable slurry suspensions of powdered materials in liquid vehicles, the apparatus comprising:

an apparatus frame;

first and second mill members mounted by the apparatus frame and providing respective first and second passage surfaces closely spaced from one another to form a flow passage between them constituting a flow path for the flow therein of the material to be treated, the flow path having a corresponding flow direction;

the passage having a passage inlet thereto and a passage outlet therefrom;

the spacing between the passage surfaces decreasing from the passage inlet to a treating zone in which the spacing between the passage surfaces is sufficiently small that the boundary layers of the material at the treating zone passage surfaces intercept one another without an intervening material layer;

motor means operatively connected to at least one of the mill members and moving the respective mill member so as to move the first and second passage surfaces relative to one another in a direction transverse to the flow direction at a relative speed such that supra-Kolmogoroff eddies are produced in the intercepting boundary layers; and ultrasonic pressure oscillation generating means mounted on at least one of the mill members so as to apply ultrasonic pressure oscillations generated thereby into the passage treating zone so as to produce therein sub-Kolmogoroff eddies of size smaller than said supra-Kolmogoroff eddies.

13. Apparatus as claimed in claim 12, wherein the mill members are circular plates mounted for rotational movement relative to one another about a common rotational axis passing through their centers, the passage surfaces being constituted by respective opposed surfaces of the two plates, and wherein the plates are also mounted for movement relative to one another along the rotational axis to vary the distance between the two opposed surfaces.

14. Apparatus as claimed in claim 13, wherein one of the circular plates is stationary and the other is rotatable, wherein the stationary plate has ultrasonic transducers mounted on its circular side opposite to the side providing the respective passage surface to produce the ultrasonic reverbatory pressure oscillations, and wherein the rotatable plate comprises means for cooling it and thus cooling the material passing in the flow passage.

15. Apparatus as claimed in claim 12, wherein the mill members are respectively a stationary hollow outer cylinder, and a rotatable inner cylinder mounted within the stationary hollow outer cylinder for rotation about a respective longitudinal rotational axis and wherein the two cylinders are also mounted for movement relative to one another transverse to the rotational axis to thereby vary the spacing between the two opposed flow passage surfaces.

16. A method as claimed in claim 12, wherein the mill members are moved so as to produce a linear velocity between the closely spaced passage surfaces relative to one another of between 0.5 and 200 meters per minute.

17. Apparatus as claimed in claim 12, wherein said passage surfaces of the mill members have a surface flatness in the range 5 nanometers to 10 micrometers per 25 cm.

18. Apparatus as claimed in claim 12, and including a reservoir connected to the mill and pump means connected between the reservoir and the mill, the pump means being operative to circulate the material to be treated between the passage and the reservoir.

19. Apparatus as claimed in claim 12, and including a reservoir connected to the mill and pump means connected between the reservoir and the mill, the pump means being operative to circulate the material to be treated between the passage and the reservoir, and means for moving the mill members toward one another to progressively reduce the height of the passage, the pump means being operative while the height of the passage is progressively reduced.

20. Apparatus as claimed in claim 12, in combination with a motionless reverbatory ultrasonic mixer in which the material to be treated is pretreated, the motionless reverbatory ultrasonic mixer having an outlet connected to the apparatus inlet for supply of retreated material thereto.

21. Apparatus as claimed in claim 12, wherein the spacing between the closely spaced passage surfaces is in the range 1-500 micrometers.

22. Apparatus as claimed in claim 12, wherein the closely spaced passage surfaces have a mirror surface finish or better.

* * * * *